US005526659A

United States Patent [19]

Takimoto

[11] Patent Number: 5,526,659

[45] Date of Patent: Jun. 18, 1996

[54] DOOR LOCKING HANDLE ASSEMBLY

[75] Inventor: Kazuhide Takimoto, Tokyo, Japan

[73] Assignee: Takigen Manufacturing Co., Ltd., Tokyo, Japan

[21] Appl. No.: 265,672

[22] Filed: Jun. 24, 1994

[51] Int. Cl.[6] ..... E05C 3/30

[52] U.S. Cl. ..... 70/99; 292/29; 292/DIG. 46; 70/407; 70/484; 70/404; 70/409

[58] Field of Search ..... 292/244, DIG. 46, 292/29, 31; 70/99, 100, 95, 402–404, 407, 409, 467, 483, 484, 485, 489

[56] References Cited

U.S. PATENT DOCUMENTS

| | | | |
|---|---|---|---|
| 2,530,330 | 11/1950 | Groeger | 70/95 |
| 2,540,686 | 2/1951 | Milburn | 292/DIG. 46 |
| 4,457,146 | 7/1984 | Weinerman | 292/340 |
| 4,511,166 | 4/1985 | Weinerman | 292/29 |
| 5,221,115 | 6/1993 | Takimoto | 292/DIG. 46 |

FOREIGN PATENT DOCUMENTS

| | | | |
|---|---|---|---|
| 727951 | 4/1932 | France | 292/31 |
| 221597 | 5/1910 | Germany | 70/99 |
| 260502 | 5/1913 | Germany | 70/99 |
| 828498 | 7/1949 | Germany | 70/99 |

*Primary Examiner*—Darnell M. Boucher
*Attorney, Agent, or Firm*—Martin Smolowitz

[57] ABSTRACT

The assembly is used in leftward- and rightward-retractable door units, and provides wide variations of key to prevent the assembly from being illegally unlocked. In the assembly: a left 25 and a right 28 latch plate are supported on pivots 22 and 54, respectively; a lock casing 17 connected with a thumb turn 15 has locking blades 18, 48; locking projections 30 and 31 abutting against the blade 18 are in the plates 25 and 28, respectively; an interlocking shaft 35 receiving torque transmitted from a front 6 and a rear 9 handle has a driving plate 40; a driving projection 39 abutting against the arms 37, 38 is in the plate 40; a locking hole 50 of a core 20 received in a lock casing 17 assumes a regular hexagonal shape in cross-section, provided that one of its six corners forms a curved surface 50*a*; a locking pin 51 extends from an inner surface of the hole 50; and, a locking projection 53 is in a center of the bottom of the core 20.

3 Claims, 6 Drawing Sheets

DOOR LOCKING HANDLE ASSEMBLY

BACKGROUND OF THE INVENTION

1. Field of the Invention

The present invention relates to a bilateral-type door locking handle assembly employed in a doorway of a ship's cabin.

2. Description of the Prior Art

Conventional door units provided in cabin's doorways of yachts and the like comprise: hinged door units in each of which a door's rotation on a hinge pin opens the doorway; and, retractable or sliding door units in each of which a door's retracting or sliding movement linearly guided by a rail opens the doorway. The retracting or sliding door units further comprise: ones in each of which a door is moved to the left to open the doorway (hereinafter referred to leftward-retractable door units); and, the other ones in each of which a door is moved to the right to open the doorway (hereinafter referred to rightward-retractable door units).

As for a conventional door locking handle assembly, it is possible for a user to mount the handle assembly in only a predetermined one of a left side and a right side of a door. In other words, it is not possible for the user to replace the handle assembly (which is designed for use in the leftward-retractable door unit) with that designed for use in the rightward-retractable door unit or vice versa. Consequently, it is required for the manufacturers to produce two different types of tile handle assembly and stock them separately, which requires a large stock space and makes it difficult to save manufacturing costs.

Further, in the conventional door locking handle assembly, since its operating handle is restricted in rotation by a simple lock mechanism which is poor in key variations, there is a fear that the door locking handle assembly is illegally unlocked through picking and like illegal acts.

SUMMARY OF THE INVENTION

It is an object of the present invention to provide a bilateral-type door locking handle assembly which is employed in both the leftward-retractable and the rightward-retractable door units, makes it possible to produce only one type of the handle assembly through mass production to save manufacturing costs and a stock space of the product, and restricts an operating handle in rotation by a locking mechanism which has wide variations of key to prevent the handle assembly from being illegally unlocked.

The above objects of the present invention are accomplished by providing:

A bilateral-type door locking handle assembly comprising:

a front casing fixedly mounted on a front side of a door;

a rear casing fixedly mounted on a rear side of the door;

a front handle having its base shaft portion rotatably mounted in a bearing portion of the front casing;

a rear handle having its base shaft portion rotatably mounted in a bearing portion of the rear casing;

a base plate which is received in the rear casing and fixedly mounted on the door;

a driving sleeve which is rotatably mounted in a bearing portion of the base plate, provided with an axial receiving groove in its side wall portion and provided with an interlocking projection in its rear-end portion;

a thumb turn having its base-end shaft portion mounted rotatably in a bearing portion of the rear casing;

a lock casing which is connected with the base-end shaft portion of the thumb turn so as to be rotatably driven together with the thumb turn, is disposed between the rear casing and tile base plate, provided with a pair of diametrically opposed locking blades in its outer surface, and provided with a receiving hole in its front side;

a locking core which is received in the receiving hole of the lock casing behind the interlocking projection of the driving sleeve, provided with a locking hole in its front surface, having a locking pin projected from an inner surface of the locking hole, and provided with a locking projection in a central portion of an inner bottom surface of the locking hole, the locking hole assuming a regular hexagonal shape in cross-section, provided that one of its six corners of the regular hexagonal shape is formed into a curved surface;

a spring disposed between the rear casing and a rectangular trunk surface of the lock casing so as to hold the thumb turn in its locking and unlocking position;

a left-side latch plate which has its intermediate portion rotatably mounted on a fixed pivot of the rear casing, its upper-end hook portion projected from a left-side opening of the rear casing, and has a locking projection formed in its upper-end shoulder portion, the locking projection abutting against the locking blade;

a right-side latch plate which has its intermediate portion rotatably mounted on a fixed pivot of the rear casing, its upper-end hook portion projected from a left-side opening of the rear casing, and a locking projection formed in its upper-end shoulder portion, the locking projection abutting against the locking blade;

a spring disposed between the rear casing and the left-side latch plate so as to bias the left-side latch plate into its locking position;

a spring disposed between the rear casing and the right-side latch plate so as to bias the right-side latch plate into its locking position;

an interlocking shaft which is rotatably mounted between the rear casing and the base plate, and provided with an axial hole in which an axial shaft of the rear handle is inserted, the axial shaft being inserted also into an axial hole of the front handle;

a driving plate which is provided in the interlocking shaft, and provided with a driving projection formed integrally with its upper-end portion, the driving projection abutting against each of a follower arm portion of the left-side latch plate and a follower arm portion of the right-side latch plate;

a key which is provided with a key rod inserted into a key hole of the front casing, has a front-end portion of the key rod formed into a predetermined shape corresponding in cross-section to that of the locking hole of the locking core so as to have the front-end portion fitted in the locking hole, is provided with an axially-extending locking groove in a side surface of the front-end portion so as to receive the locking projection of the locking core in the locking groove, is provided with a locking concave portion in a central portion of its end surface so as to receive the locking projection of the locking core in the locking concave portion, and, is provided with a locking pin in a side surface of the key rod, the locking pin being inserted into the receiving groove of the driving sleeve, the predetermined shape of the front-end portion of the key rod being a regular hexagonal shape, provided that one of its six corners of the regular hexagonal shape is formed into a curved surface;

a socket piece provided in a left-side post wall of a doorway so as to be engaged with and disengaged from the front-end hook portion of the left-side latch plate; and a socket piece provided in a right-side post wall of the doorway so as to be engaged with and disengaged from the front-end hook portion of the right-side latch plate.

DESCRIPTION OF THE PREFERRED EMBODIMENTS

Figure 1:
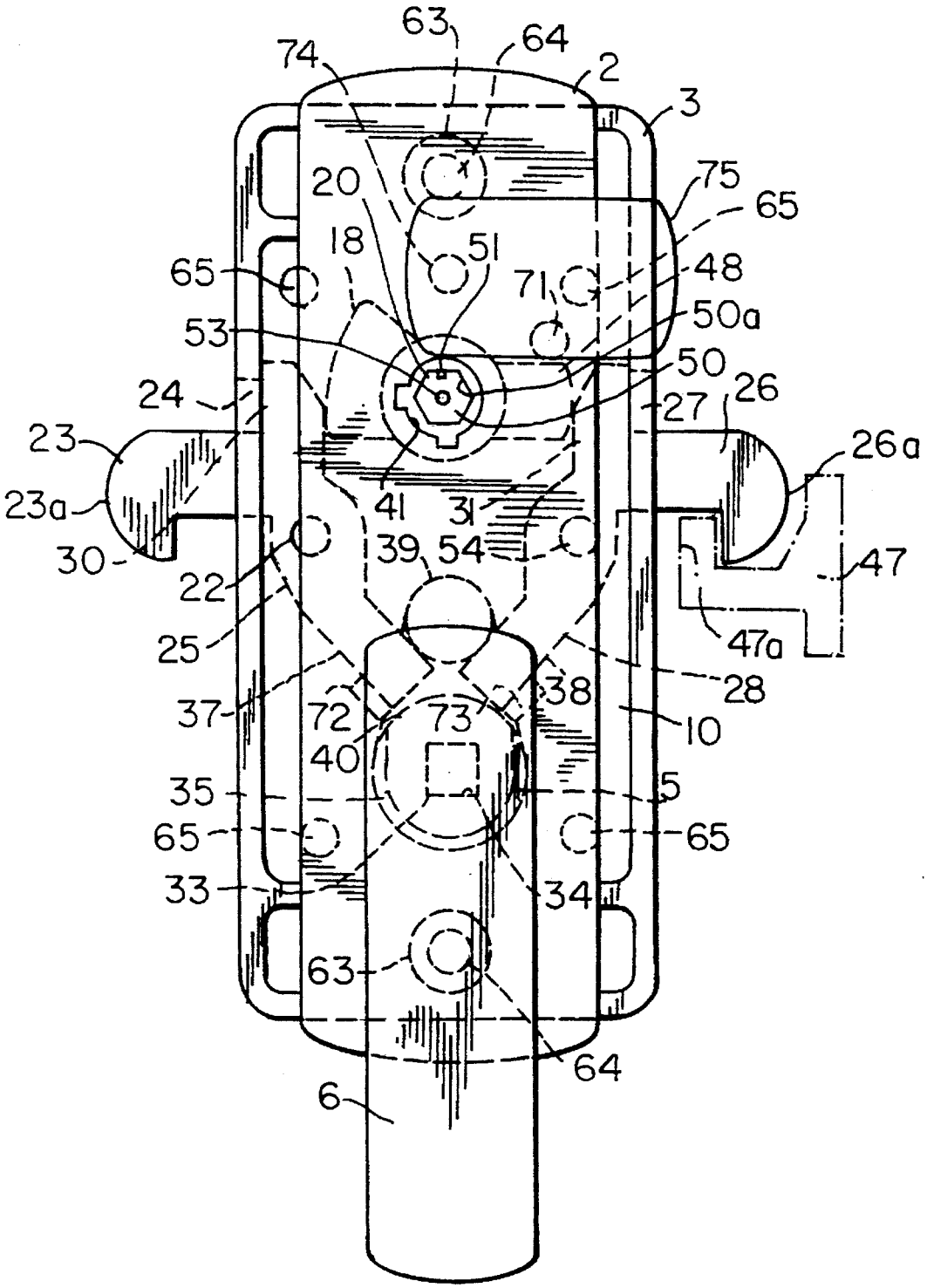
FIG. 1 is a front view of an embodiment of the door locking handle assembly of the present invention.
Figure 2:
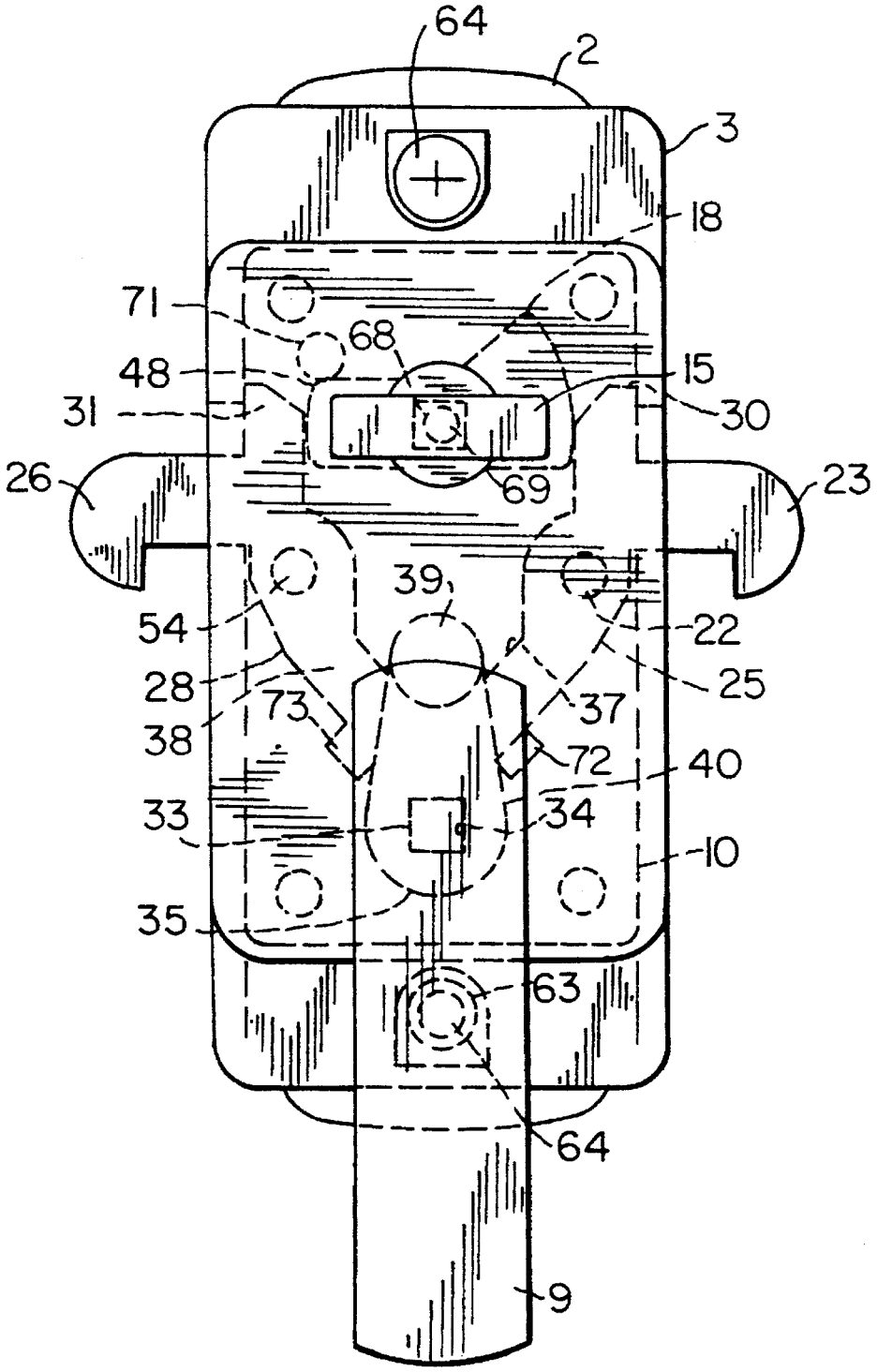
FIG. 2 is a rear view of the door locking assembly of the present invention shown in FIG. 1.
Figure 3:
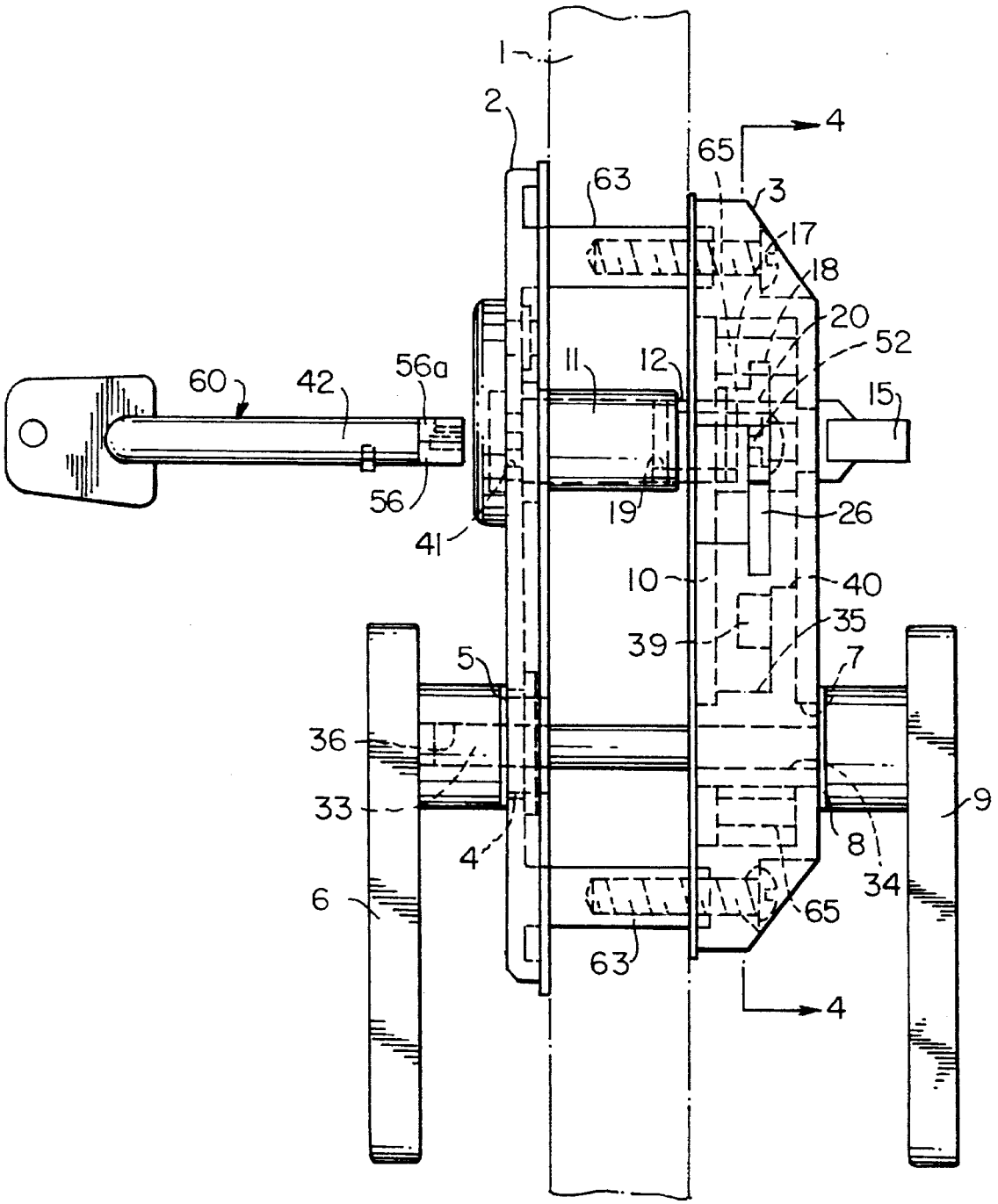
FIG. 3 is a right side view of the door locking assembly of the present invention shown in FIG. 1.

Hereinbelow, the present invention will be described in detail with reference to the accompanying drawings and the reference numerals and characters.

A bilateral-type door locking handle assembly of the present invention comprises: a front casing 2 fixedly mounted on a front side of a door 1; a rear casing 3 fixedly mounted on a rear side of the door 1; a front handle 6 having its base shaft portion 5 rotatably mounted in a bearing portion 4 of the front casing 2; a rear handle 9 having its base shaft portion 8 rotatably mounted in a bearing portion 7 of the rear casing 3; a base plate 10 which is received in the rear casing 3 and fixedly mounted on the door 1; a driving sleeve 12 which is rotatably mounted in a bearing portion 16 of the base plate 10, provided with an axial receiving groove 19 in its side wall portion and provided with an interlocking projection 29 in its rear-end portion; and, a thumb turn 15 having its base-end shaft portion 14 mounted rotatably in a bearing portion 13 of the rear casing 3.

The door locking handle assembly of the present invention further comprises: a lock casing 17 which is connected with the base-end shaft portion 14 of the thumb turn 15 so as to be rotatably driven together with the thumb turn 15, is disposed between the rear casing 3 and tile base plate 10, provided with a pair of diametrically opposed locking blades 18, 48 in its outer surface, and provided with a receiving hole 49 in its front side; a locking core 20 which is received in the receiving hole 49 of the lock casing 17 behind the interlocking projection 29 of, the driving sleeve 12, provided with a locking hole 50 in its front surface, having a locking pin 51 projected from an inner surface of the locking hole 50, and provided with a locking projection 53 in a central portion of an inner bottom surface of the locking hole 50, the locking hole 50 assuming a regular hexagonal shape in cross-section, provided that one of its six corners of the regular hexagonal shape is formed into a curved surface 50*a*; and, a spring 21 disposed between the rear casing 3 and a rectangular trunk surface 52 of the lock casing 17 so as to hold the thumb turn 15 in its locking and unlocking position.

Still further, the door locking handle assembly of the present invention comprises: a left-side latch plate 25 which has its intermediate portion rotatably mounted on a fixed pivot 22 of the rear casing 3, its upper-end hook portion 23 projected from a left-side opening 24 of the rear casing 3, and has a locking projection 30 formed in its upper-end shoulder portion, the locking projection 30 abutting against the locking blade 18; a right-side latch plate 28 which has its intermediate portion rotatably mounted on a fixed pivot 54 of the rear casing 3, its upper-end hook portion 26 projected from a left-side opening 27 of the rear casing 3, and a locking projection 31 formed in its upper-end shoulder portion, the locking projections 31 abutting against the locking blade 48; a spring 32 disposed between the rear casing 3 and the left-side latch plate 25 so as to bias the left-side latch plate 25 into its locking position; a spring 55 disposed between the rear casing 3 and the right-side latch plate 28 so as to bias the right-side latch plate 28 into its locking position; an interlocking shaft 35 which is rotatably mounted between the rear casing 3 and the base plate 10, and provided with an axial hole 34 in which an axial shaft 33 of the rear handle 9 is inserted, the axial shaft 33 being inserted also into an axial hole 36 of the front handle 6; and, a driving plate 40 which is provided in the interlocking shaft 35, and provided with a driving projection 39 formed integrally with its upper-end portion, the driving projection 39 abutting against each of a follower arm portion 37 of the left-side latch plate 25 and a follower arm portion 38 of the right-side latch plate 28.

The door locking handle assembly of the present invention further comprises: a key 60 which is provided with a key rod 42 inserted into a key hole 41 of the front casing 2, has a front-end portion 56 of the key rod 42 formed into a predetermined shape corresponding in cross-section to that of the locking hole 50 of the locking core 20 so as to have the front-end portion 56 fitted in the locking hole 50, is provided with an axially-extending locking groove 57 in a side surface of the front-end portion 56 so as to receive the locking projection 53 of the locking core 20 in the locking groove 57, is provided with a locking concave portion 58 in a central portion of its end surface so as to receive the locking projection 53 of the locking core 20 in the locking concave portion 58, and, is provided with a locking pin 59 in a side surface of the key rod 42, the locking pin 59 being inserted into the receiving groove 19 of the driving sleeve 12, the predetermined shape of the front-end portion 56 of the key rod 42 being a regular hexagonal shape, provided that one of its six corners of the regular hexagonal shape is formed into a curved surface 56*a*; a socket piece 45 provided in a left-side post wall 44 of a doorway 43 so as to be engaged with and disengaged from the front-end hook portion 23 of the left-side latch plate 25; and, a socket piece 47 provided in a right-side post wall 46 of the doorway 43 so as to be engaged with and disengaged from the front-end hook portion 26 of the right-side latch plate 28.

Figure 4:
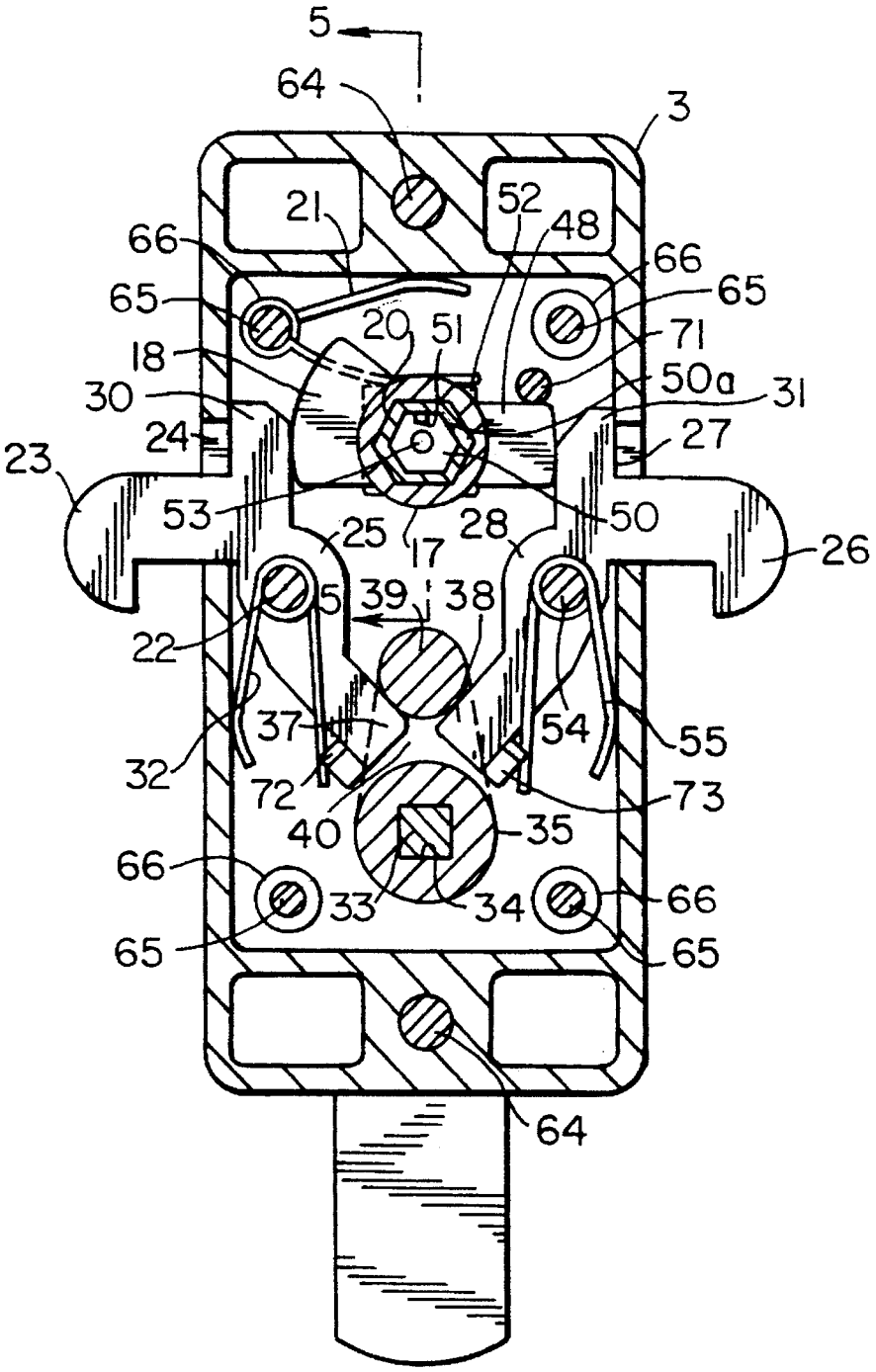
FIG. 4 is a longitudinal sectional view of the door locking assembly of the present invention, taken along the line A—A of FIG. 3.
Figure 8:
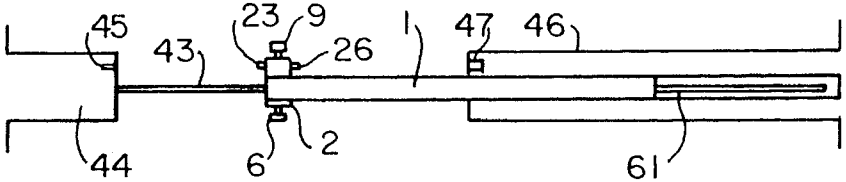
FIG. 8 is a schematic plan view of the door locking assembly of the present invention employed in a sliding door unit in which the door is slidably moved to the right to open the doorway.
Figure 7:
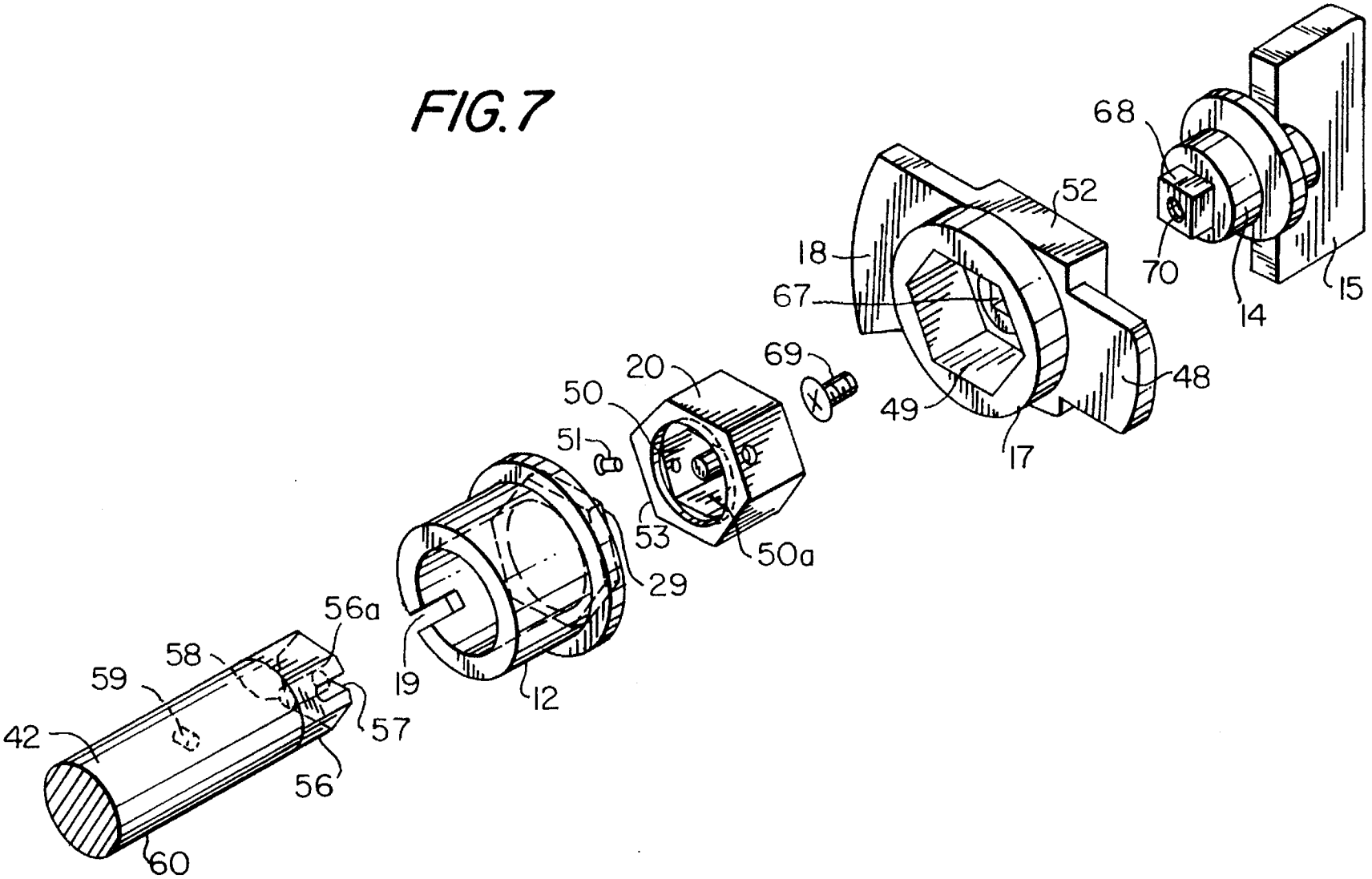
FIG. 7 is an exploded perspective view of the locking mechanism portion of the door locking assembly of the present invention shown in FIG. 1.

In operation, first, as shown in FIG. 8, in the rightward-retractable door unit, when the user moves the door 1 to the left by using the front handle 6 or the rear handle 9 so that the doorway is closed, a circularly-curved cam surface 23*a* (shown in FIG. 1) of the upper-end hook portion 23 of the left-side latch plate 25 is brought into a slidable contact with an edge portion of an opening of the socket piece 45 at the end of the closing movement of the door 1 so that the left-side latch plate 25 is rotated temporarily clockwise as viewed in FIG. 4. When the door 1 abuts against the left-side post wall 44 to reach its closed position so that the upper-end hook portion 23 of the left-side latch plate 25 passes through the edge portion of the opening of the socket piece 45, the left-side latch plate 25 is rotated counterclockwise under the influence of a resilient force exerted by a spring 32 so that the upper-end hook portion 23 of the latch plate 25 is fully engaged with the socket piece 45. Since the spring 32 keeps the upper-end hook portion 23 of the latch plate 25 engaged with the socket piece 45 under the influence of its resilient force as described above, the door 1 is held in its closed position.

Figure 6:
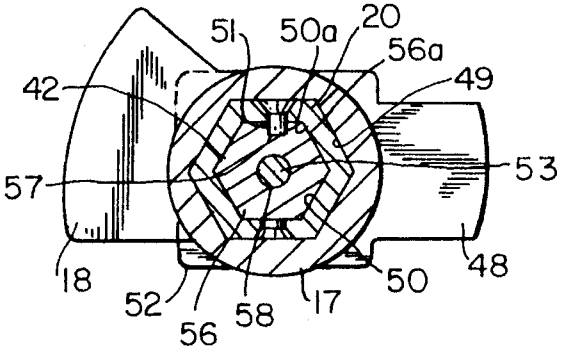
FIG. 6 is a cross-sectional view of the door locking assembly of the present invention, taken along the line C—C of FIG. 5.
Figure 5:
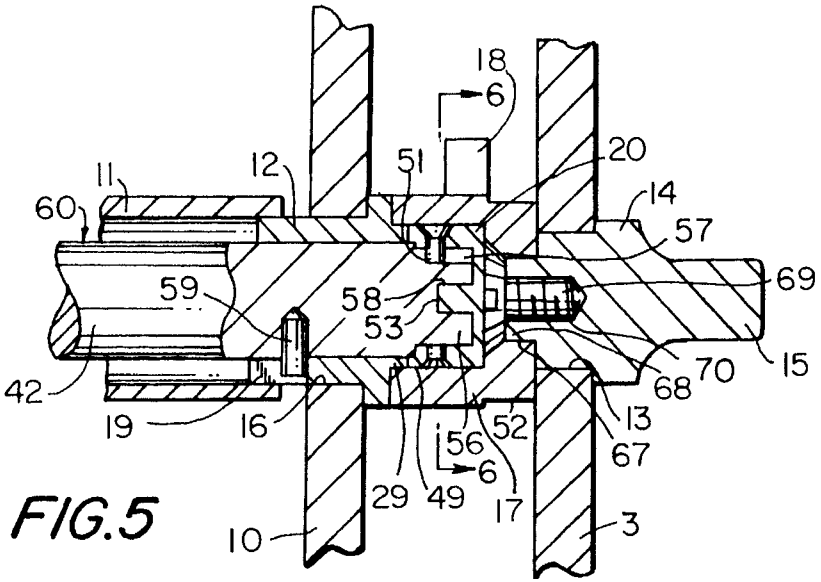
FIG. 5 is a longitudinal sectional view of the door locking assembly of the present invention, taken along the line B—B of FIG. 4.

In case that the user locks the door i in a front side thereof, the key rod 42 of the key 60 is inserted into the key hole 41 of the front casing 2 so that: the front-end portion 56 of the key rod 42 is inserted into the locking hole 50 of the locking core 20; the locking pin 51 of the locking core 20 is inserted into the locking groove 57 of the front-end portion 56 of the key rod 42; the locking projection 53 of the locking core 20 is inserted into the locking concave portion 58 of the front-end portion 56 of the key rod 42; and, the locking pin 59 of the key rod 42 is inserted into the receiving groove 19 of the driving sleeve 12. After that, the key rod 42 is rotated counterclockwise so that the lock casing 17 assumes its horizontal position as shown in FIG. 6. At this time, the left-side locking blade 18 of the lock casing 17 abuts against the locking projection 30 of the left-side latch plate 25.

On the other hand, when the user locks the door 1 in the rear side thereof, the user rotates the thumb turn 15 so that the lock casing 17 is rotated in the same direction as that of the base-end shaft portion 14 of the thumb turn 15. As a result, the locking blade 18 of the lock casing 17 abuts against the locking projection 30 of the latch plate 25 to prevent the latch plate 25 from performing its clockwise turn, which makes it impossible to turn the front handle 6 or the rear handle 9 so as to open the door 1. Consequently, the door 1 is held in its locked position.

In case that the user opens the door 1 in its front side in a condition in which the door 1 is locked by the locking blade 18 of the lock casing 17, he or she unlocks the door locking handle assembly, and then grips the front handle 6. In case that the door locking assembly is not unlocked, the user immediately grips the front handle 6. After that, the interlocking shaft 35 is rotated counterclockwise as viewed in FIG. 4. In this rotating operation, the driving projection 39 of the driving plate 40 pushes the follower arm portion 37 of the left-side latch plate 25 so that the latch plate 25 rotates clockwise, and the upper-end hook portion 23 is disengaged from the socket piece 45 in the left-side post wall 44. After that, when the front handle 6 is pulled to the right as viewed in FIG. 8, the door 1 is separated from the left-side post wall 44 and then retracted or received in a door storage space 61 of the right-side post wall 46, so that the doorway 43 is opened.

In case that the door 1 is opened in its rear side as viewed in FIG. 8 in a condition in which the door locking handle assembly is locked by means of the thumb turn 15, the user unlocks the thumb turn 15 and then grips the rear handle 9. When the thumb turn 15 is not locked, he or she immediately grips the rear handle 9 so that the interlocking shaft 35 is rotated counterclockwise as viewed in FIG. 4. In this rotating operation, the driving projection 39 of the driving plate 40 pushes the follower arm portion 37 of the left-side latch plate 25, so that the latch plate 25 rotates clockwise to have its upper-end hook portion 23 disengaged from the socket piece 45. After that, when the rear handle 9 is pulled to the right as viewed in FIG. 8, the door 1 is separated from the left-side post wall 44 and then retracted or received in the door storage space 61 of the right-side post wall 46 so that the doorway 43 is opened.

In the end of any one of the above-described door's opening operations performed in opposite sides of the door 1, the circularly-curved cam surface 26*a* of the upper-end hook portion 26 of the right-side latch plate 28 is brought into a slidable contact with the edge portion of the opening of the socket piece 47 to have the latch plate 28 rotated temporarily counterclockwise as viewed in FIG. 4. When the door 1 reaches its closed position so that the front-end hook portion 26 of the latch plate 28 passes through the edge portion of the opening of the socket piece 47, the right-side latch plate 28 is rotated clockwise under the influence of the resilient force exerted by the spring 55 to have its upper-end hook portion 26 of the latch plate 28 engaged with the socket piece 47. Since the spring 55 biases the upper-end hook portion 26 of the latch plate 28 into the socket piece 47 to hold the upper-end hook portion 26 therein, the door 1 is held in its opened position.

In case that the door 1 is locked in its front side, the key rod 42 of the key 60 is inserted into the key hole 41 of the front casing 2 so that: the front-end portion 56 of the key rod 42 is inserted into the locking hole 50 of the locking core 20; the locking pin 51 of the locking core 20 is inserted into the locking groove 57 of the front-end portion 56 of the key rod 42; the locking projection 53 of the locking core 20 is inserted into the locking concave portion 58 of the front-end portion 56 of the key rod 42; and, the locking pin 59 of the key rod 42 is inserted into the receiving groove 19 of the driving sleeve 12. After that, the key rod 42 is rotated counterclockwise so as to have the lock casing 17 assume its horizontal position as viewed in FIG. 6. In this rotating operation, the right-side locking blade 48 of the lock casing 17 abuts against the locking projection 31 of the right-side latch plate 28.

On the other hand, in case that the door 1 is locked in its rear side, first of all, the thumb turn 15 is rotated so that the lock casing 17 is rotated in the same direction as that of the thumb turn 15 through the base-end shaft portion 14 of the thumb turn 15, whereby the locking blade 48 of the lock casing 17 abuts against the locking project, ion 31 of the right-side latch plate 28 to prevent the latch plate 28 from rotating counterclockwise. As a result, it is not possible to rotate both the front handle 6 and the rear handle 9, and, therefore not possible to close the door 1, whereby the door 1 is locked in its opened position.

Figure 9:
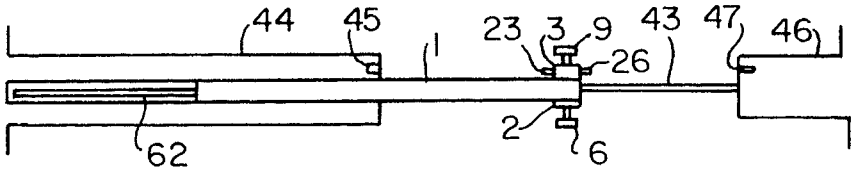
FIG. 9 is a schematic plan view of the door locking assembly of the present invention employed in a sliding door unit in which the door is slidably moved to the left to open the doorway.

In case that the door locking handle assembly of the present invention is employed in the leftward-retractable door unit as shown in FIG. 9, the upper-end hook portion 26 of the right-side latch plate 28 engages with the socket piece 47 of the right-side post wall 46 at the end of closing operation of the door 1. On the other hand, the upper-end hook portion 23 of the left-side latch plate 25 engages with the socket piece 45 of the left-side post wall 44 at the end of opening operation of the door 1 so that the door 1 is received in a door storage space 62 of the left-side post wall 44. Opening/closing and locking/unlocking operations of the door 1 of the leftward-retractable door unit shown in FIG. 9 are the same in manner as those of the rightward-retractable door unit shown in FIG. 8.

Namely, in case that the user opens the door 1 in its front side in a condition in which the door 1 is locked by the locking blade 18 of the lock casing 17, he or she unlocks the door locking handle assembly, and then grips the front handle 6. In case that the door locking assembly is not unlocked, the user immediately grips the front handle 6. After that, the interlocking shaft 35 is rotated clockwise as viewed in FIG. 4. In this rotating operation, the driving projection 39 of the driving plate 40 pushes the follower arm portion 38 of the right-side latch plate 28 so that the latch plate 28 rotates counterclockwise, and the upper-end hook portion 26 is disengaged from the socket piece 47 of the right-side post wall 46. After that, when the front handle 6 is pulled to the left as viewed in FIG. 9, the door 1 is separated from the right-side post wall 46 so that the doorway 43 is opened.

In case that the door 1 is opened in its rear side as viewed in FIG. 8 in a condition in which the door locking handle assembly is locked by means of the thumb turn 15, the user unlocks the thumb turn 15 and then grips the rear handle 9. When the thumb turn 15 is not locked, he or she immediately grips the rear handle 9 so that the interlocking shaft 35 is rotated counterclockwise as viewed in FIG. 4. In this rotating operation, the driving projection 39 of the driving plate 40 pushes the follower arm portion 38 of the right-side latch plate 28 so that the latch plate 28 rotates counterclockwise, and the upper-end hook portion 26 is disengaged from the socket piece 47 of the right-side post wall 46. After that, when the front handle 6 is pulled to the left as viewed in FIG. 9, the door 1 is separated from the right-side post wall 46 so that the doorway 43 is opened.

In the end of any one of the above-described door's opening operations performed in opposite sides of the door 1, the circularly-curved cam surface 23*a* of the upper-end hook portion 23 of the left-side latch plate 25 is brought into a slidable contact with the edge portion of the opening of the socket piece 45 to have the latch plate 25 rotated temporarily clockwise as viewed in FIG. 4. When the door 1 teaches its closed position so that the front-end hook portion 23 of the latch plate 25 passes through the edge portion of the opening of the socket piece 45, the left-side latch plate 25 is rotated counterclockwise under the influence of the resilient force exerted by the spring 32 to have its upper-end hook portion 23 of the latch plate 25 engaged with the socket piece 45. Since the spring 32 biases the upper-end hook portion 23 of the latch plate 25 into the socket piece 45 to hold the upper-end hook portion 23 therein, the door 1 is held in its opened position.

In the embodiment of the present invention shown in the drawings, both the front casing 2 and the rear casing 3 are fixedly mounted on the door 1 by means of screws 64, each of which is inserted into the door 1 from the rear side thereof and threadably engaged with a threaded hole of each of cylindrical boss portions 63 of the front casing 2. The base plate 10 is embedded in a front-end portion of the rear casing 3, and fixedly mounted therein by means of screws 65 each of which is threadably engaged with a threaded hole of each of cylindrical boss portions 66 of the rear casing 3. The return spring 21 of the lock casing 17 is constructed of a coil spring mounted on one of the cylindrical boss portions 66 of the rear casing 3. The locking projection 29 of the driving sleeve 12 assumes a regular hexagonal shape in cross-section. A connecting sleeve portion 11 provided in a rear surface of the front casing 2 receives a front-end portion of the driving sleeve 12. The receiving hole 49 of the lock casing 17 assumes a regular hexagonal shape in cross-section, and, therefore the locking core 20 assumes a corresponding regular hexagonal shape in cross-section to form a hexagonal nut-like piece.

A square hole 67 of a central portion of a rear surface of the lock casing 17 receives a corresponding square projection 68 of the base-end shaft portion 14 of the thumb turn 15, and then the lock casing 17 is fixedly mounted on the thumb turn 15 by means of a screw 69 which is threadably engaged with a threaded hole 70 of the square projection 68 of the thumb turn 15. The rear casing 3 is provided with a stopping projection 71 for stopping the locking blade 48 of the lock casing 17 at its locking position. The return springs 32 and 55, which are constructed of coil springs, are mounted on the fixed pivots 22 and 54 of the rear casing 3, respectively. Provided in the lower-end portions of the left-side latch plate 25 and the right-side latch plate 28 are spring-support projections 72 and 73, respectively. The axial shaft 33, which assumes a square shape in cross-section, is integrally formed with the rear handle 9 and received in both of a corresponding square axial hole 34 of a central portion of the interlocking shaft 38 and a corresponding square axial hole 36 of the front handle 6. Pivotally mounted on the front casing 2 through a pivot 74 is a cap 75 for closing the key hole 41 of the front casing 2.

In the door locking handle assembly of the present invention having the above construction: the left-side latch plate 25 and the right-side latch plate 28 are rotatably mounted on the rear casing 3 through the fixed pivots 22 and 54, respectively; The lock casing 17, which is connected with the base-end shaft portion 14 of the thumb turn 15, is provided with the locking blades 18, 48; the locking projection 30 abutting against the locking blade 18 is provided in an upper-end shoulder portion of the left-side latch plate 25; the locking projection 31 abutting against the locking blade 48 is provided in the upper-end shoulder portion of the right-side latch plate 28; the axial shaft 33, to which torque is transmitted from the front handle 6 and the rear handle 9, is received in the interlocking shaft 35; the interlocking shaft 35 is provided with the driving plate 40; and, the driving plate 40 is provided with the driving projection 39 in its upper-end portion to have the driving projection 39 abut against both the follower arm portion 37 of the left-side latch plate 25 and the follower arm portion 38 of the right-side latch plate 28. Consequently, the door locking handle assembly of the present invention does not require any conversion in assembling works nor require any additional parts in manufacturing when it is used in any one of the leftward-retractable and the rightward-retractable door units, which makes it possible to produce only one type product through mass production, and, therefore to save both the manufacturing costs and the storage space of the product.

Further, in the door locking handle assembly of the present invention: the locking core 20 is fixedly mounted in the receiving hole 49 of the lock casing 17; the locking hole 50, which opens in a front surface of the locking core 20, assumes a regular hexagonal shape in cross-section, provided that one of its six corners is formed into the circularly-curved surface 50*a*; the locking pin 51 extends radially inwardly from the inner surface of the locking hole 50; the locking projection 53 is provided in the central portion of the inner bottom surface of the locking core 20; the receiving hole 19, which extends axially, is provided in the driving sleeve 12; the front-end portion 56 of the key rod 42 assumes a regular hexagonal shape, provided that one of its six corners is formed into the circularly-curved surface 56*a*: the locking groove 57, which extends axially, is provided in the side surface of the front-end portion 56 of the key rod 42; the locking concave portion 58, which receives the locking projection 53, is provided in the central portion of the end surface of the front-end portion 56 of the key rod 42; and, the locking pin 59, which is inserted into the receiving groove 19 of the driving sleeve 12, is provided in the side surface of the key rod 42. In addition, in the door locking handle assembly of the present invention has a wide variation of keys in setting directions and positions of key components, which makes it substantially impossible to unlock the door locking handle assembly of the present invention through illegal acts such as picking and the like.

Further, in the door locking handle assembly of the present invention, it is also possible to provide wider variations of keys by modifying; the locking core 20, locking pin 51 and the circularly-curved surface 50*a* of the locking hole 50 in arrangement therebetween; the locking projection 53 in projection length; and, the receiving groove 19 of the driving sleeve 12 and the circularly-curved surface 50*a* of the locking hole 50 in arrangements therebetween.

What is claimed is:

1. A bilateral-type door locking handle assembly comprising:

a front casing (2) fixedly mounted on a front side of a door (1);

a rear casing (3) fixedly mounted on a rear side of said door (1);

a front handle (6) having its base shaft portion (5) rotatably mounted in a bearing portion (4) of said front casing (2);

a rear handle (9) having its base shaft portion (8) rotatably mounted in a bearing portion (7) of said rear casing (3);

a base plate (10) which is received in said rear casing (3) and fixedly mounted on said door (1);

a driving sleeve (12) which is rotatably mounted in a bearing portion (16) of said base plate (10), provided with an axial receiving groove (19) in its side wall portion and provided with an interlocking projection (29) in its rear-end portion;

a thumb turn (15) having its base-end shaft portion (14) mounted rotatably in a bearing portion (13) of said rear casing (3);

a lock casing (17) which is connected with said base-end shaft portion (14) of said thumb turn (15) so as to be rotatably driven together with said thumb turn (15), is disposed between said rear casing (3) and said base plate (10), provided with a pair of diametrically opposed locking blades (18), (48) in its outer surface, and provided with a receiving hole (49) in its front side;

a locking core (20) which is received in said receiving hole (49) of said lock casing (17) behind said interlocking projection (29) of said driving sleeve (12), provided with a locking hole (50) in its front surface, having a locking pin (51) projected from an inner surface of said locking hole (50), and provided with a locking projection (53) in a central portion of an inner bottom surface of said locking hole (50), said locking hole (50) assuming a regular hexagonal shape in cross-section, provided that one of its six corners of said regular hexagonal shape is formed into a curved surface (50*a*);

wherein said assembly is adapted for use with a spring (21) disposed between said rear casing (3) and a rectangular trunk surface (52) of said lock casing (17) so as to hold said thumb turn (15) in its locking and unlocking position;

a left-side latch plate (25) which has its intermediate portion rotatably mounted on a fixed pivot (22) of said rear casing (3), its upper-end hook portion (23) projected from a left-side opening (24) of said rear casing (3), and has a locking projection (30) formed in its upper-end shoulder portion, said locking projection (30) abutting against said locking blade (18);

a right-side latch plate (28) which has its intermediate portion rotatably mounted on a fixed pivot (54) of said rear casing (3), its upper-end hook portion (26) projected from a left-side opening (27) of said rear casing (3), and a locking projection (31) formed in its upper-end shoulder portion, said locking projection (31) abutting against said locking blade (48);

a spring (32) disposed between said rear casing (3) and said left-side latch plate (25) so as to bias said left-side latch plate (25) into its locking position;

a spring (55) disposed between said rear casing (3) and said right-side latch plate (28) so as to bias said right-side latch plate (28) into its locking position;

an interlocking shaft (35) which is rotatably mounted between said rear casing (3) and said base plate (10), and provided with an axial hole (34) in which an axial shaft (33) of said rear handle (9) is inserted, said axial shaft (33) being inserted also into an axial hole (36) of said front handle (6);

a driving plate (40) which is provided in said interlocking shaft (35), and provided with a driving projection (39) formed integrally with its upper-end portion, said driving projection (39) abutting against each of a follower arm portion (37) of said left-side latch plate (25) and a follower arm portion (38) of said right-side latch plate (28);

a key (60) which is provided with a key rod (42) inserted into a key hole (41) of said front casing (2), has a front-end portion (56) of said key rod (42) formed into a predetermined shape corresponding in cross-section to that of said locking hole (50) of said locking core (20) so as to have said front-end portion (56) fitted in said locking hole (50), is provided with an axially-extending locking groove (57) in a side surface of said front-end portion (56) so as to receive said locking projection (53) of said locking core (20) in said locking groove (57), is provided with a locking concave portion (58) in a central portion of its end surface so as to receive said locking projection (53) of said locking core (20) in said locking concave portion (58), and, is provided with a locking pin (59) in a side surface of said key rod (42), said locking pin (59) being inserted into said receiving groove (19) of said driving sleeve (12), said predetermined shape of said front-end portion (56) of said key rod (42) being a regular hexagonal shape, provided that one of its six corners of said regular hexagonal shape is formed into a curved surface (56*a*);

a socket piece (45) provided in a left-side post wall (44) of a doorway (43) so as to be engaged with and disengaged from said front-end hook portion (23) of said left-side latch plate (25); and a socket piece (47) provided in a right-side post wall (46) of said doorway (43) so as to be engaged with and disengaged from said front-end hook portion (26) of said right-side latch plate (28).

2. The door locking handle assembly according to claim 1, wherein said front casing (2) and said rear casing (3) are mounted onto the door 1 by multiple screws (64) extending through the door.

3. The door locking handle assembly according to claim 1, wherein said base plate (10) is embedded in a front-end portion of said rear casing and is mounted onto said rear casing by multiple screws (65).

* * * * *